US007743600B2

(12) United States Patent
Babu et al.

(10) Patent No.: US 7,743,600 B2
(45) Date of Patent: Jun. 29, 2010

(54) GAS TURBINE ENGINE TELEMETRY MODULE

(75) Inventors: Michael Babu, Fairfield, CT (US); Michael Ian Walker, Cromwell, CT (US); William G. Sheridan, Southington, CT (US); Richard E. Domonkos, Wethersfield, CT (US); Michael T. Chelte, Chicopee, MA (US)

(73) Assignee: United Technologies Corporation, Hartford, CT (US)

( * ) Notice: Subject to any disclaimer, the term of this patent is extended or adjusted under 35 U.S.C. 154(b) by 1121 days.

(21) Appl. No.: 11/397,100

(22) Filed: Apr. 4, 2006

(65) Prior Publication Data

US 2007/0233415 A1 Oct. 4, 2007

(51) Int. Cl.
*F02C 7/12* (2006.01)

(52) U.S. Cl. ..... 60/39.83; 60/39.08; 60/803

(58) Field of Classification Search ..... 60/39.08, 60/772, 39.83, 803, 725; 702/182–185, 33–36, 702/41–44, 113, 121–123, 188, 189, 45; 73/112.01, 112.03, 112.05, 114.68; 340/870.07; 324/207.25, 760

See application file for complete search history.

(56) References Cited

U.S. PATENT DOCUMENTS 4,153,141 A 5/1979 Methlie
4,611,464 A * 9/1986 Hetzer et al. ..... 60/792
4,709,155 A * 11/1987 Yamaguchi et al. ..... 250/554
4,729,102 A 3/1988 Miller, Jr. et al.
4,729,424 A * 3/1988 Mizuno et al. ..... 165/261
5,134,843 A * 8/1992 Wakeman ..... 60/803
5,185,700 A 2/1993 Bezos et al.
6,257,065 B1 * 7/2001 Kyrtsos ..... 73/654
6,262,659 B1 7/2001 Korkosz et al.
6,799,112 B1 * 9/2004 Carter et al. ..... 701/100
6,910,863 B2 * 6/2005 Scardicchio et al. ..... 416/1
7,046,164 B2 * 5/2006 Gao et al. ..... 340/854.4
7,241,053 B2 * 7/2007 Sato et al. ..... 384/448
7,475,549 B2 * 1/2009 Alexander et al. ..... 60/772
7,523,615 B2 * 4/2009 Singh et al. ..... 60/772
7,562,519 B1 * 7/2009 Harris et al. ..... 60/39.08
2006/0038988 A1 * 2/2006 Thermos ..... 356/241.1
2007/0025843 A1 * 2/2007 Dejaune et al. ..... 415/170.1

* cited by examiner

*Primary Examiner*—Michael Cuff
*Assistant Examiner*—Young Choi
(74) *Attorney, Agent, or Firm*—Kinney & Lange, P.A.

(57) ABSTRACT

A sensor assembly for a gas turbine engine includes a telemetry module mounted at a rotor bearing compartment for sensing engine operational parameters and a cooling system for cooling the telemetry module separate from a rotor bearing lubricant flow.

18 Claims, 4 Drawing Sheets

GAS TURBINE ENGINE TELEMETRY MODULE

BACKGROUND OF THE INVENTION

The present invention relates to sensor assemblies and methods of collecting data. More particularly, the present invention relates to assemblies and methods for obtaining operational data regarding a gas turbine engine.

Traditionally, data regarding the components of a gas turbine engine is gathered in a piecemeal fashion, before the engine is assembled for operation. Operating characteristics of the engine are estimated from pre-operational component data. A disadvantage of this approach is that these estimations may vary from actual values under operating conditions. However, it is desired to obtain operational data from a gas turbine engine in a fully operational state. An impediment to achieving such desired data collection is the difficulty in mounting a suitable sensor apparatus on a gas turbine engine in a manner that does not adversely affect engine operation. A sensor apparatus that adversely affects engine operation can lead to engine damage and can distort or otherwise affect the data collected. For example, cooling the sensor apparatus may disrupt cooling oil flows to bearings located adjacent to the data collection apparatus, which can undesirably affect engine performance as well as sensed engine data.

BRIEF SUMMARY OF THE INVENTION

A sensor assembly according to the present invention includes a telemetry module mounted at a rotor bearing compartment for sensing gas turbine engine operational parameters and a cooling system for cooling the telemetry module separate from a rotor bearing lubricant flow.

DETAILED DESCRIPTION

The present invention provides a telemetry module assembly and method for sensing gas turbine engine operational parameters. The telemetry module assembly permits engine data to be sensed while the gas turbine engine is in a substantially fully operational state. Sensed parameters can be transmitted to a data system for collection, storage, processing, etc. The telemetry module assembly is relatively easy to install in a gas turbine engine, and the installed, operational telemetry module assembly does not adversely affect engine operation. For instance, bearing oil supply can be maintained after the telemetry module is installed. Moreover, the assembly and method of the present invention also provides cooling of the telemetry module assembly using a gaseous nitrogen (GN2) coolant. Typically, the telemetry module assembly is installed on a gas turbine engine located in a laboratory or shop setting suitable for conducting bench testing, although the assembly can be used in other contexts as well.

Figure 1:
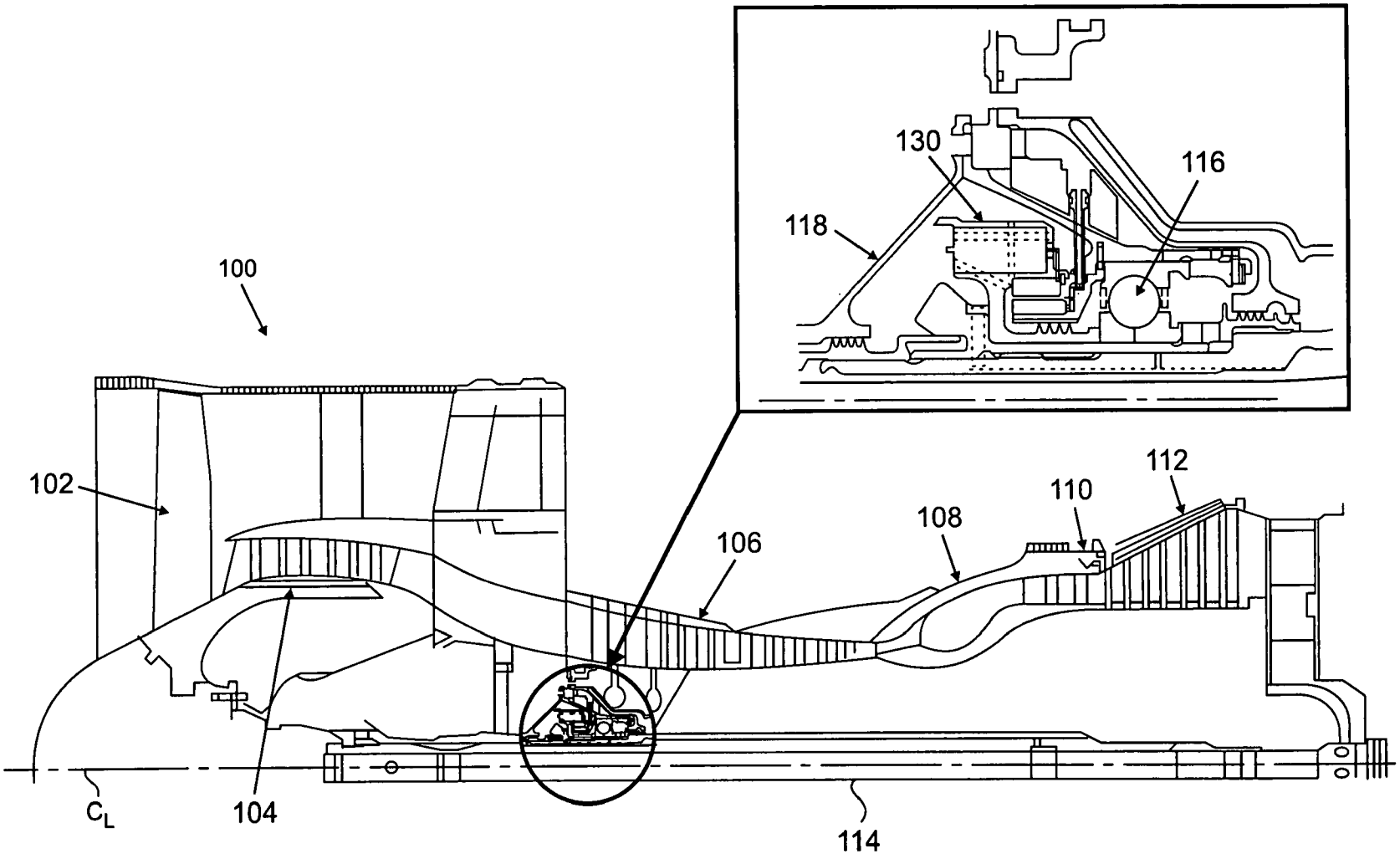
FIG. 1 is a simplified schematic view of a portion of a gas turbine engine having a telemetry module assembly according to the present invention.

FIG. 1 is a simplified schematic view of a portion of a gas turbine engine 100. The engine 100 can be, for example, a model CFM56-3 gas turbine engine commercially available from CFM International, Inc., Cincinnati, Ohio. The engine 100 includes a fan 102, a low pressure compressor assembly 104, a high pressure compressor assembly 106, a combustor assembly 108, a high pressure turbine assembly 110, a low pressure turbine assembly 112, and a rotor shaft assembly 114. The rotor shaft assembly 114 is aligned with an engine centerline $C_L$. The engine 100 further includes a bearing assembly 116 (known in the art as a "#3 bearing") that is located in a bearing compartment 118. Details of the bearing assembly 116 and the bearing compartment 118 are explained more fully below, with respect to FIG. 2. The engine 100 also includes other conventional components that may not be specifically shown in FIG. 1 for simplicity.

It should be noted that although only a portion of the engine 100 above the centerline $C_L$ is shown in FIG. 1, those skilled in the art will recognize that the portion of the engine below the centerline $C_L$ is similar. Moreover, the basic operation of gas-turbine engines is well-known in the art, and so further explanation is unnecessary for purposes of understanding the present invention.

Figure 2:
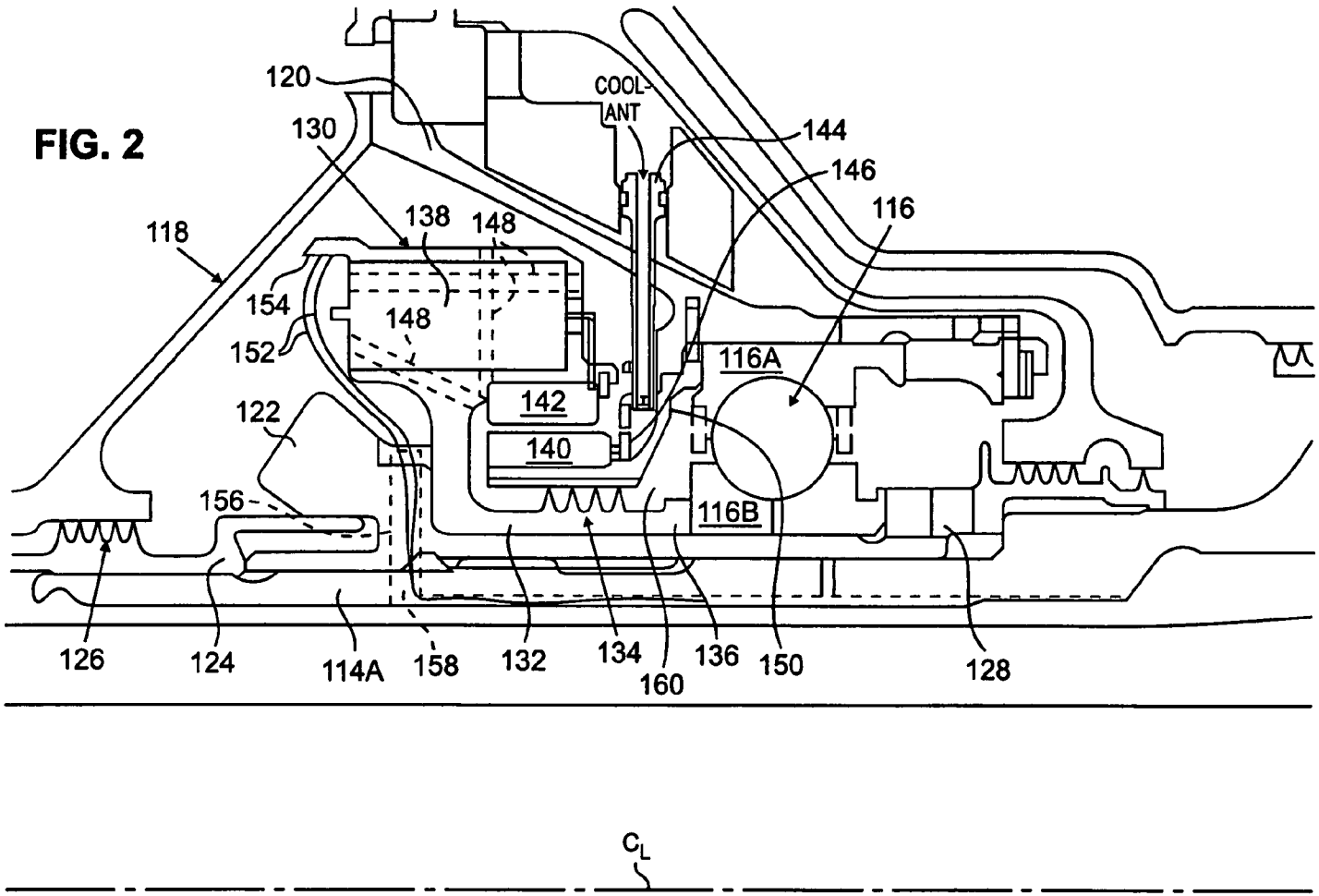
FIG. 2 is a cross-sectional view of a portion of the gas turbine engine and telemetry module assembly.

FIG. 2 is an enlarged cross-sectional view of a portion of the gas turbine engine 100, showing how a telemetry module assembly can be installed or retrofitted on a commercially available gas turbine engine. As shown in FIG. 2, the bearing compartment 118 includes a bearing support 120, a bull gear 122, a forward nut 124 having a knife edge seal portion 126, and an aft nut 128. The bearing assembly 116 includes an outer race 116A and an inner race 116B. The inner race 116B of the bearing assembly 116 is axially fixed relative to the bull gear 122 for rotation therewith about the engine centerline $C_L$. The bull gear 122 is in turn secured to a high pressure compressor (HPC) hub 114A for rotation therewith. The aft nut 128 axially secures the bearing assembly 116 to prevent movement in an aft direction relative to the rotor shaft assembly 114.

A telemetry module assembly 130 is installed adjacent to the bearing assembly 116. The telemetry module assembly 130 includes a support 132 having a knife edge seal portion 134 and a bearing stop portion 136, a number of transmitter modules 138, a stationary (primary) coil 140, a rotatable (secondary) coil 142, a telemetry coolant supply tube 144, and a telemetry coolant showerhead 146. The transmitter modules 138 are discrete components that are radially spaced around the engine centerline $C_L$ in a generally uniform circular pattern. The transmitter modules 138 are each fixed within the telemetry support 132. A number of coolant passageways 148 are formed through the support 132 and adjacent to the transmitter modules 138. The rotatable coil 142 is a hoop-like structure concentric with the engine centerline $C_L$ that is mounted to the telemetry support 132, to enable rotation therewith. The stationary coil 140 is a hoop-like structure concentric with the engine centerline $C_L$ that is fixed relative to the bearing support 120, on a coil support 150 (also called a telemetry stator) secured thereto. The stationary coil 140 is positioned adjacent to the rotatable coil 142, and is located radially inward of the rotatable coil 142. A small radial air gap is formed between the coils 140 and 142. The coil support 150 engages with the knife edge seal portion 134 of the telemetry support 132. Wires 152 extend from a connection portion 154 located on the telemetry support 132. The wires 152 are used to electrically connect the transmitter modules 138 to other components, such as strain gages and thermocouples, to provide paths for carrying power, data signals, etc. Details of the configuration and operation of the electrical aspects of the telemetry module assembly 130 are explained in greater detail below, with respect to FIG. 4.

The bull gear 122 is a gear modified from the type used in commercially available engines, such as a model CFM56-3 gas turbine engine, in order to accommodate the telemetry module assembly 130. The bull gear 122 is secured around the HPC hub 114A, and is secured thereto by the forward nut 124 and the aft nut 128. The bull gear 122 abuts a forward portion of the telemetry module support 132 to prevent axial movement of the support 132 in a forward direction with respect to the shaft 114. A conduit 156 is formed through the bull gear 122, and joins with a cavity 158 in the HPC hub 114A. The conduit 156 and the cavity 158 enable the wires 152 to extend between the connection portion 154 and other components disposed on or near the rotor shaft assembly 114.

The bearing support 120 is a support modified from the type used in commercially available engines, such as a model CFM56-3 gas turbine engine, in order to accommodate the telemetry module assembly 130. The bearing support 120 permits insertion of the bull gear 122 and other components of the telemetry module assembly 130 into the bearing compartment 118 from a forward portion of the engine 100. This facilitates relatively simple and easy installation of the telemetry module assembly 130 on a commercially available gas turbine engine. In addition, the bearing support 120 can include openings and other structures for providing bearing lubricant scavenging capabilities, in order to collect and reuse the lubricant previously provided to the bearing assembly 116.

The telemetry coolant supply tube 144 is connected at its radially outward end to tubing (not shown), which forms a coolant supply path that extends to the exterior of the engine 100. The coolant supply path can be connected via further supply tubing to a suitable coolant supply storage container and a suitable coolant pump, both of which can be located outside the engine 100 (e.g., the coolant can be stored and pumped from equipment located next to the engine 100 within a testing facility). The radially inward end of the supply tube 144 is connected to the showerhead 146, which is positioned slightly aft of the air gap between the stationary coil 140 and the rotatable coil 142. In further embodiments, a number of supply tubes 144 and showerheads 146 can be provided in circumferentially spaced locations about the engine centerline $C_L$ in order to deliver coolant at multiple locations simultaneously.

In a preferred embodiment, the coolant used to cool the telemetry module assembly 130 is gaseous nitrogen (GN2). It has been found that a coolant made substantially entirely from GN2 provides a low transmitter mortality rate as compared to the use of oil coolants or mixed oil/GN2 coolants.

In operation, telemetry coolant is provided through the supply tube 144 and is directed by the showerhead 146 toward the air gap between the coils 140 and 142. A significant portion of the telemetry coolant flows axially forward through the air gap, while some telemetry coolant also flows radially outward across aft portions of the support 132 and transmitter modules 138. Most of the telemetry coolant that flows through the air gap will then flow through the passageways 148, while the remaining telemetry coolant that passes through the air gap will then flow across the knife edge seal portion 134 (which forms a labyrinthine seal between the bull gear 122 and the support 150 for the rotatable coil 140) to a cavity 160 defined immediately forward of the bearing assembly 116. Telemetry coolant flowing within the bearing compartment 118 cools the telemetry module assembly 130, and, in particular, cools the transmitter modules 138 that are generally susceptible to undesirable mortality issues when operating in relatively high-temperature environments. Flows of telemetry coolant dissipate into environmental air from the bearing compartment 118.

In order to mount the telemetry module assembly 130 in the engine 100, some components in commercially available gas turbine engines (e.g., model CFM56-3 gas turbine engines) must be relocated or modified in order to provide suitable space to mount telemetry components while still maintaining proper engine operation. As described above, the bull gear 122 and the bearing support 120 generally differ from stock components of commercially available gas turbine engines. Another part that generally must be modified to install the telemetry module assembly 130 is the forward bearing lubricant supply jet, which normally is a long, arcing jet (with a relatively high length/diameter ratio for fluid flow) that would occupy a central portion of the bearing compartment 118 now occupied by the telemetry module assembly 130. Other existing lubricant flow components, such as those providing an aft bearing lubricant flow, can generally be left undisturbed.

Figure 3:
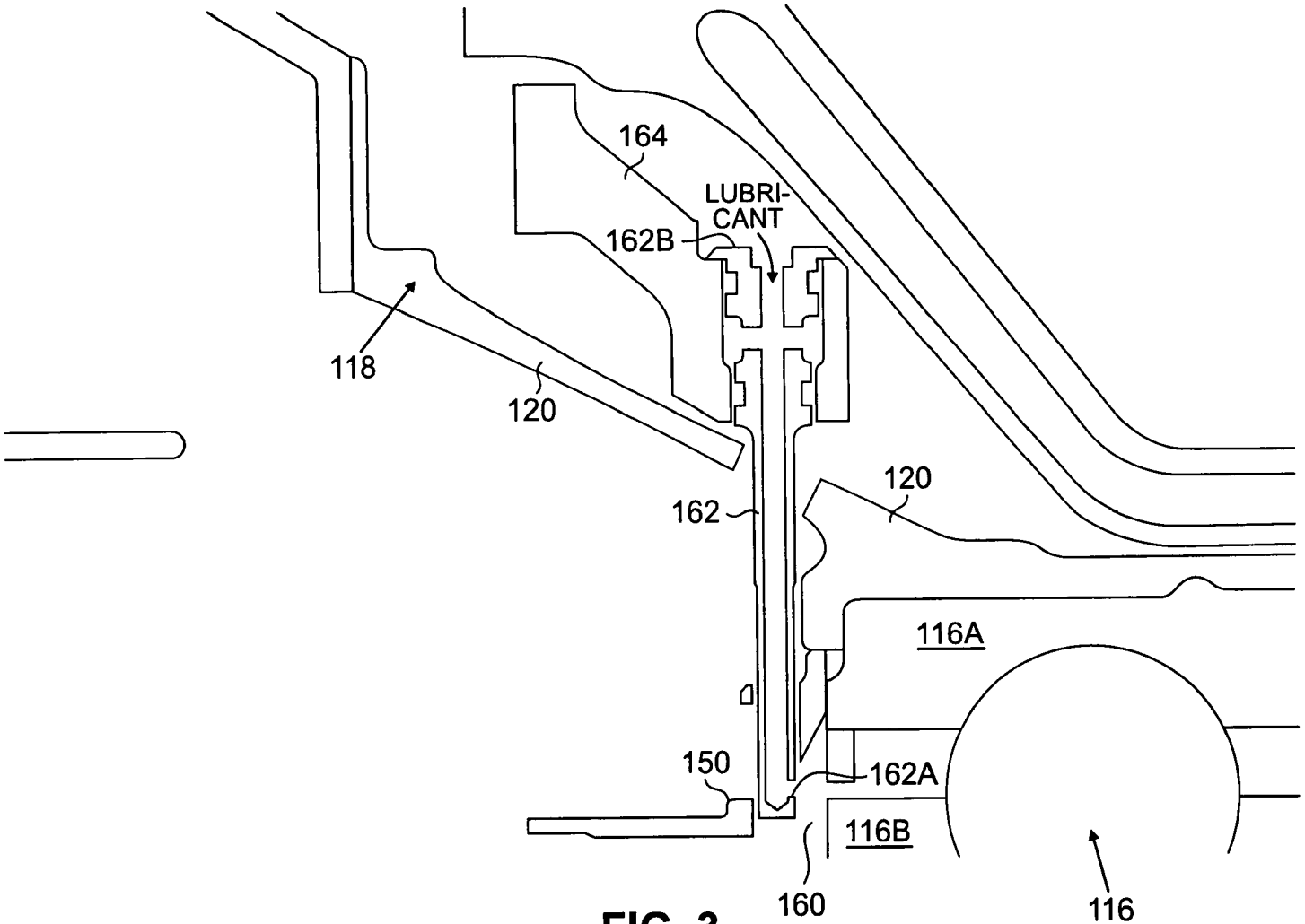
FIG. 3 is a cross-sectional view of a portion of the gas turbine engine assembly showing a modified bearing coolant jet.

FIG. 3 is a cross-sectional view of a portion of the bearing compartment 118 showing a modified bearing lubricant jet 162. The jet 162 extends radially with respect to the engine centerline $C_L$. An aft-facing outlet 162A of the jet 162 is positioned in the cavity 160, forward of the bearing assembly 116, to provide a forward bearing coolant flow to the gap formed between the outer and inner bearing races 116A and 116B. The outlet 162A is located in close proximity to the bearing assembly 116. In the embodiment shown in FIG. 3, the outlet 162A is located about one inch or less from the bearing assembly 116. Moreover, the jet 162 and its outlet 162A provide a relatively low length/diameter (L/D) ratio for fluid flow therethrough. An outer end 162B of the jet 162 is mounted on a bearing lubricant supply housing 164, located inside the bearing compartment 118. The jet 162 is located at a position such that its outer end 162B is circumferentially spaced about the engine centerline $C_L$ with respect to the telemetry coolant supply tube 144 and showerhead 146. This allows the jet 162 to be positioned in a way that avoids interference with other parts. In further embodiments, a number of jets 162 can be provided in circumferentially spaced locations about the engine centerline $C_L$.

It should be noted that the bearing lubricant is preferably separate and independent from the telemetry coolant supply. The bearing lubricant is a conventional jet engine oil lubricant chemistry. It should also be understood that the lubricant can also provide functionality as a coolant. Bearing lubricant is restricted from flowing near the electronic components of the telemetry module assembly 130. The small flow of telemetry coolant across the knife edge seal portion 134 of the telemetry support 132 creates a fluid barrier to help prevent bearing lubricant from flowing forward from the cavity 160 and to help prevent mixing of telemetry coolant with bearing lubricant.

The particular design and arrangement of the lubricant jet 162 will vary depending on the particular layout of bearing compartment 118 of the gas turbine engine 100. However, it is generally desired to provide a consistent bearing lubricant flow that avoids foaming, lubrication flow deprivation, and other disruptions. This ensures that the gas turbine engine 100 will function properly when in operation, which helps ensure accurate sensing of engine operation parameters by the telemetry module assembly 130.

Figure 4:
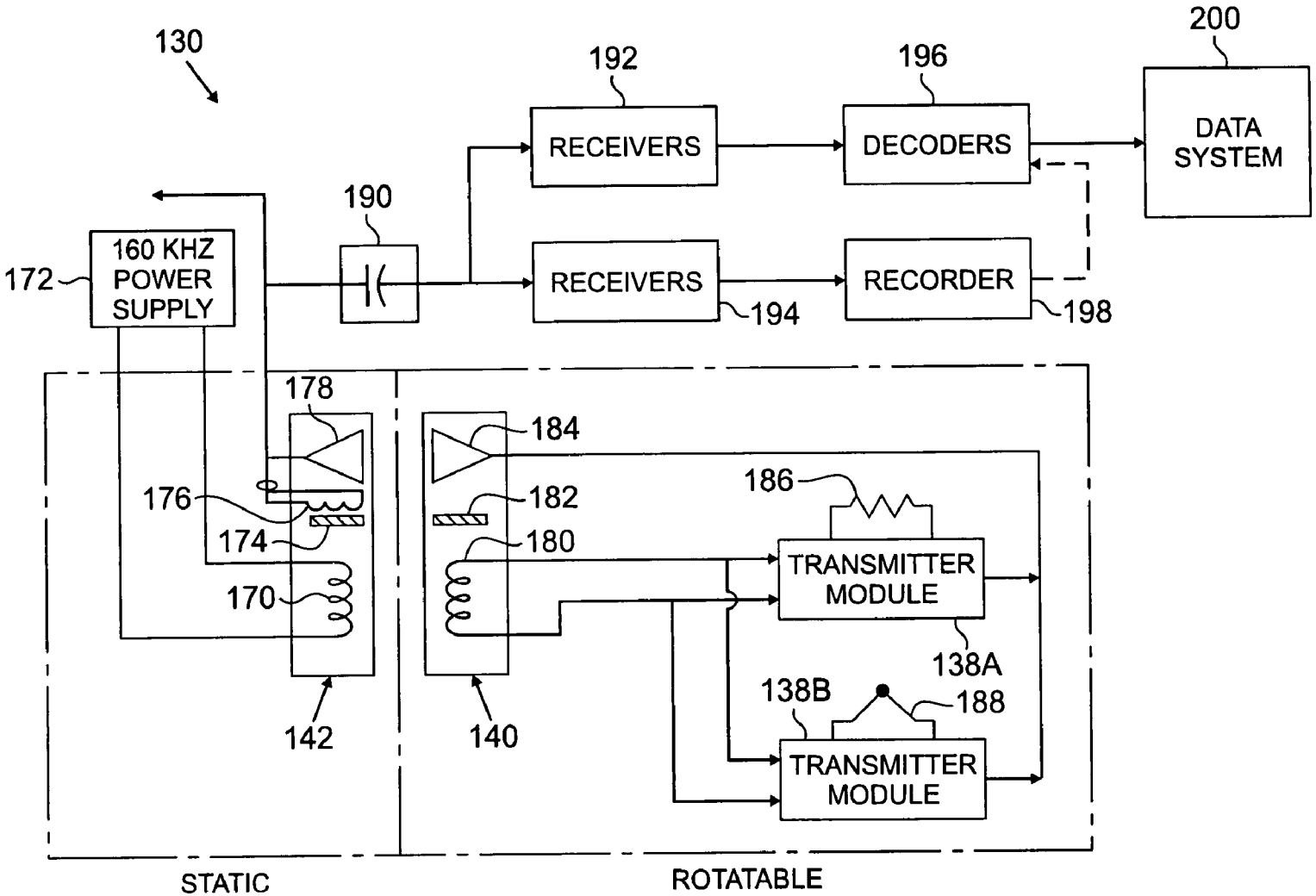
FIG. 4 is a block diagram of the telemetry module assembly.

FIG. 4 is a block diagram of the telemetry module assembly 130. The stationary (primary) coil 142 of the assembly 130 includes an inductor coil 170 connected to an external power supply 172 (which can be a 160 kHz AC power supply), a magnet 174, an inductive pickup 176 adjacent to the magnet 174, and a radio frequency (RF) antenna 178. The rotatable (secondary) coil 140 includes an inductor coil 180, a magnet 182, and a RF transmitter antenna 184.

The inductor coil 180 of the rotatable coil 140 is electrically connected to the transmitter modules 138 (only two transmitter modules 138A and 138B are shown, though fewer or greater numbers of transmitter modules can be included). Electrical power from the power supply 172 is supplied to the inductor coil 170. The inductor coils 170 and 180 form a transformer to transmit power across the air gap between the stationary coil 142 and the rotatable coil 140. The inductor coil 180 of the rotatable coil 140 is electrically connected to the transmitter modules 138. Transmitter module 138A is connected to a strain gage 186, depicted as a resistor, and transmitter module 138B is connected to a thermocouple 188. The strain gage 186 and the thermocouple 188 enable strain and temperature data to be sensed while the engine 100 is in operation. The transmitter modules 138A and 138B, which can produce RF signals, are connected to the transmitter antenna 184 to transmit data signals across the air gap between the coils 140 and 142 to the antenna 178. Each transmitter 138 is a molded electronic module that can be generally cylindrical in shape. Each transmitter 138 operates at a particular frequency band (e.g., one between about 50-150 MHz FM), enabling data signals containing particular types of data to be later identified according to their transmission frequency band.

The pickup 176 in the stationary coil 142 enables the telemetry module 130 to count the number of rotations of the magnet 182 of the rotatable coil 140 relative to the magnet 174 of the stationary coil 142. The pickup 176 enables rotational data to be sensed from the engine 100 while in operation, and for corresponding data signals to be generated.

Signals from the various data sources (including signals from the pickup 176 and the antenna 178) are sent in unison to a polarized capacitor 190. From capacitor 190, the signals pass to two sets of receivers 192 and 194. The first set of receivers 192 are connected to a corresponding set of decoder circuitry 196. One receiver 192 and decoder 196 is provided for each type of signal (e.g., rotational, temperature, strain, etc.), in order to receive and convert signals into a desired format (e.g., a varying voltage signal). The second set of receivers 194 is connected to recorder circuitry 198 for recording raw signal transmission, without any decoding. The recorder circuitry 198 creates a data back-up system, with raw data that can be decoded at a later time as desired. The decoder circuitry 196 is connected to a data system 200, for collecting, organizing, processing and storing sensed and decoded data. It is also possible to send data stored by the recorder circuitry 198 to the data system 200 after the raw recorded data has been decoded.

It should be recognized that the present invention provides a number of benefits. The telemetry module assembly of the present invention allows operational data to be gathered from a fully assembled and fully operational gas turbine engine without adversely affecting engine performance. The use of a dedicated GN2 telemetry coolant provides excellent cooling to the telemetry module assembly while avoiding any undesired disruption of the oil-based bearing lubricant supply. In addition, the telemetry module assembly can be installed and operated in a relatively simple and easy fashion.

Although the present invention has been described with reference to preferred embodiments, workers skilled in the art will recognize that changes may be made in form and detail without departing from the spirit and scope of the invention. For instance, the telemetry module assemblies and methods of sensing engine data of the present invention can be utilized with nearly any type of gas turbine engine. Moreover, the present invention is readily applicable to both testing (i.e., laboratory) contexts and operational (i.e., flight) contexts.

What is claimed is:

1. A sensor assembly for a gas turbine engine, the assembly comprising:

a rotor bearing lubricant flow for providing lubricant to a bearing located in a rotor bearing compartment;

a telemetry module mounted radially inward from a rotatable compressor assembly at the rotor bearing compartment for sensing engine operational parameters; and a cooling system which utilizes a gaseous nitrogen coolant for cooling the telemetry module separate from the rotor bearing lubricant flow.

2. The assembly of claim 1 and further comprising: a labyrinthine seal for restricting flow of the rotor bearing lubricant flow while permitting flow of the gaseous nitrogen coolant across the seal.

3. The assembly of claim 1, wherein the cooling system does not utilize engine oil lubricant to achieve cooling of the telemetry module.

4. The assembly of claim 1 and further comprising:

a bearing configured to permit the telemetry module to be installed from a front side of the bearing support.

5. The assembly of claim 4 and further comprising:

a compartment forming a cavity at a forward side of the bearing support, wherein the telemetry module is located within the cavity of the compartment.

6. The assembly of claim 1, wherein the telemetry module includes a rotatable coil and a static coil for sensing rotational data.

7. The assembly of claim 1 and further comprising:

a wireless transceiver for wirelessly transmitting signals from the telemetry module.

8. The assembly of claim 7 and further comprising:

a strain gage electrically connected to the wireless transceiver.

9. The assembly of claim 7 and further comprising:

a thermocouple electrically connected to the wireless transceiver.

10. The assembly of claim 1 and further comprising:

a rotor bearing assembly; and a radially-extending bearing oil jet with a targeting feature located in close proximity to the bearing assembly.

11. A gas turbine engine assembly comprising:

a rotor bearing having a bearing lubricant flow; and a telemetry module installed adjacent to the rotor bearing and radially inward from a rotatable airfoil assembly for detecting operational characteristics of the gas-turbine engine, the telemetry module having a telemetry coolant flow which comprises a gaseous nitrogen coolant that is separate from the bearing lubricant flow.

12. The assembly of claim 11, wherein the telemetry coolant flow does not utilize engine oil to achieve cooling of the telemetry module.

13. The assembly of claim 12 and further comprising:

a radially-extending lubricant jet having a lubricant targeting feature located in close proximity to the rotor bearing.

14. A method of collecting engine data for a gas-turbine engine, the method comprising:

modifying a bearing lubricant flow to a bearing of a production gas-turbine engine;

installing a telemetry module radially inward from a rotatable compressor assembly and adjacent to the bearing for operation without disruption of the bearing lubricant flow to the bearing;

providing a telemetry coolant flow which utilizes a gaseous nitrogen coolant to the telemetry module, wherein the telemetry coolant flow is separate from the bearing lubricant flow; and generating a signal based on engine data collected by the telemetry module during engine operation.

15. The method of claim 14 and further comprising the step of:

replacing the bearing of the production gas-turbine engine with a modified bearing before installing the telemetry module.

16. The method of claim 14, wherein the telemetry module is installed forward of the bearing.

17. The method of claim 14 and further comprising the step of:

wirelessly transmitting the signal to a receiver.

18. The method of claim 14, wherein a portion of the telemetry coolant flow is made to flow adjacent to the bearing coolant flow in order to maintain separation between the telemetry coolant flow and the bearing coolant flow.

* * * * *